US009869963B2

(12) United States Patent
Ueshima

(10) Patent No.: US 9,869,963 B2
(45) Date of Patent: Jan. 16, 2018

(54) IMAGE FORMING APPARATUS WITH OPENING AND CLOSING MEMBER AND REACTION FORCE GENERATING MECHANISM

(71) Applicant: FUJI XEROX CO., LTD., Tokyo (JP)

(72) Inventor: Akira Ueshima, Yokohama (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/246,831

(22) Filed: Aug. 25, 2016

(65) Prior Publication Data

US 2017/0248901 A1 Aug. 31, 2017

(30) Foreign Application Priority Data

Feb. 29, 2016 (JP) ..... 2016-036536

(51) Int. Cl.
*G03G 21/16* (2006.01)

(52) U.S. Cl.
CPC ..... *G03G 21/1633* (2013.01)

(58) Field of Classification Search
CPC ..... G03G 21/1633
USPC ..... 399/124, 125, 110
See application file for complete search history.

(56) References Cited

U.S. PATENT DOCUMENTS 5,999,772 A * 12/1999 Kakitani ..... G03G 21/1628 347/138
2007/0091387 A1* 4/2007 Kakuta ..... H04N 1/00543 358/498
2008/0175620 A1* 7/2008 Ohta ..... G03G 21/1628 399/125
2010/0239311 A1* 9/2010 Kikuchi ..... G03G 15/1605 399/111
2010/0247142 A1* 9/2010 Kikuchi ..... G03G 21/1853 399/112
2012/0027422 A1* 2/2012 Itabashi ..... G03G 15/0886 399/12
2012/0256429 A1 10/2012 Nagaoka et al.
2015/0042108 A1 2/2015 Okawa et al.

FOREIGN PATENT DOCUMENTS

JP 2011-127383 A 6/2011
JP 2011-127420 A 6/2011
JP 2015-031132 A 2/2015

* cited by examiner

*Primary Examiner* — Sandra Brase
(74) *Attorney, Agent, or Firm* — Oliff PLC

(57) ABSTRACT

An image forming apparatus includes an opening and closing member that is movably supported between an opening position at which an inner portion of a main body of the apparatus is opened and a closing position at which the inner portion of the main body of the apparatus is closed, an engaged portion that is provided in the main body of the apparatus, an engaging member that is provided in the opening and closing member and is engaged to the engaged portion, and a reaction force generating mechanism that is provided in the opening and closing member, and urges the opening and closing member toward the opening position when the opening and closing member moves from the opening position to the closing position.

7 Claims, 8 Drawing Sheets

Prior Art

Prior Art

IMAGE FORMING APPARATUS WITH OPENING AND CLOSING MEMBER AND REACTION FORCE GENERATING MECHANISM

CROSS-REFERENCE TO RELATED APPLICATIONS

This application is based on and claims priority under 35 USC 119 from Japanese Patent Application No. 2016-036536 filed Feb. 29, 2016.

BACKGROUND

Technical Field

The present invention relates to an image forming apparatus.

SUMMARY

According to an aspect of the invention, there is provided an image forming apparatus, including:

an opening and closing member that is movably supported between an opening position at which an inner portion of a main body of the apparatus is opened and a closing position at which the inner portion of the main body of the apparatus is closed;

an engaged portion that is provided in the main body of the apparatus;

an engaging member that is provided in the opening and closing member and is engaged to the engaged portion; and a reaction force generating mechanism that is provided in the opening and closing member, and urges the opening and closing member toward the opening position when the opening and closing member moves from the opening position to the closing position.

BRIEF DESCRIPTION OF THE DRAWINGS

Exemplary embodiments of the present invention will be described in detail based on the following figures, wherein.

DETAILED DESCRIPTION

Figure 1:
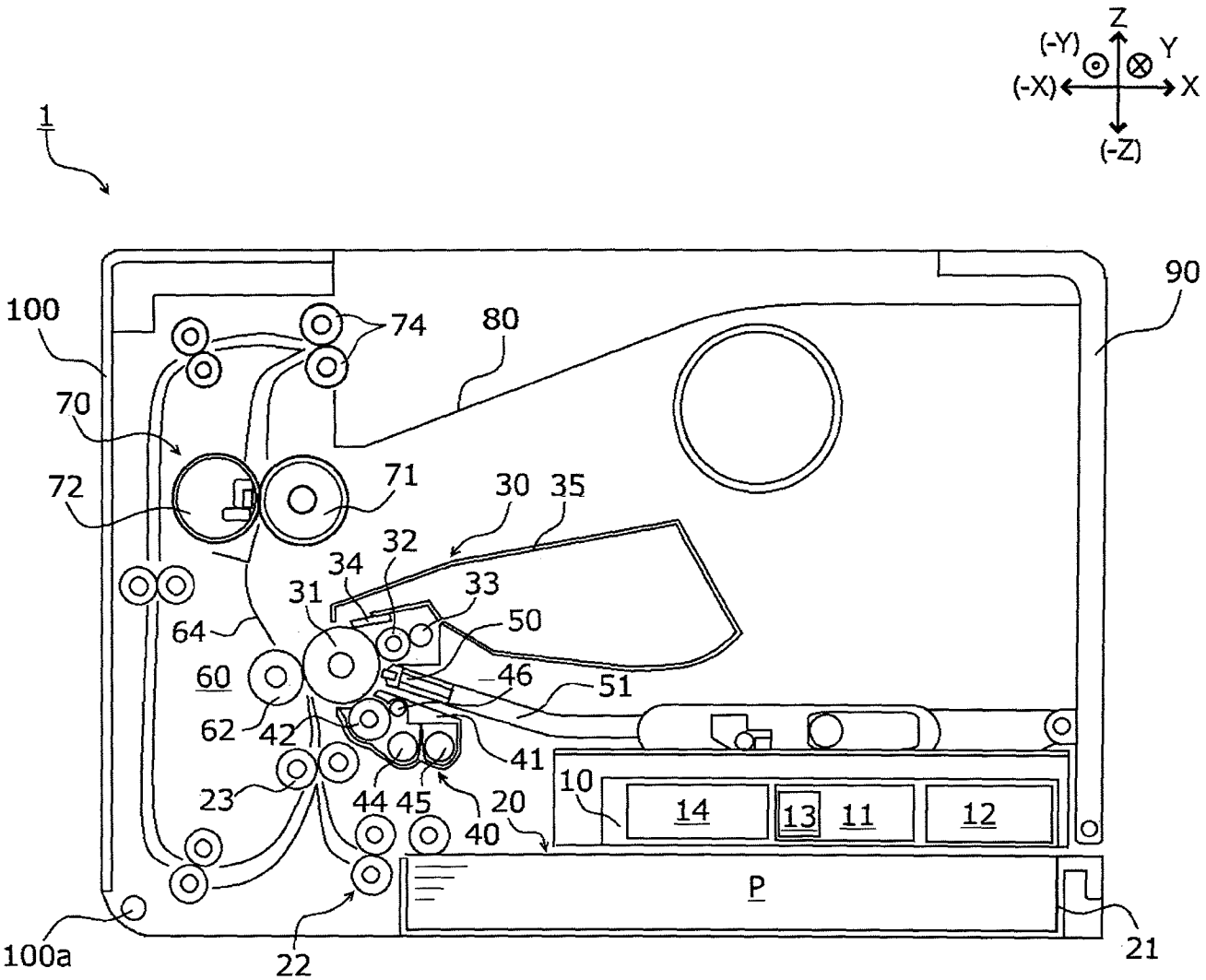
FIG. 1 is a cross-sectional schematic diagram illustrating a construction of an inner portion of an image forming apparatus.

Next, with reference to the drawings, an exemplary embodiment of the invention is described in more detail while citing exemplary embodiments and specific examples to be described below. However, the exemplary embodiment of the invention is not limited to the exemplary embodiments and the specific examples.

In addition, in the following description using the drawings, the drawings are schematic drawings and it should be noted that the ratio of the each dimension or the like is different from the actual ratio of each dimension. Illustration of members other than members which are necessary for the description for ease of understanding is omitted as appropriate.

Furthermore, in order to facilitate understanding of the following description, in the drawings, the longitudinal direction is referred to as the X-axis direction, the lateral direction is referred to as the Y-axis direction, and the vertical direction is referred to as the Z-axis direction.

First Exemplary Embodiment (1) Entire Construction and Operation of Image Forming Apparatus FIG. 1 is a longitudinal cross-sectional schematic diagram illustrating a construction of an inner portion of an image forming apparatus 1 according to an exemplary embodiment.

Hereinafter, with reference to the drawings, the entire construction and operation of the image forming apparatus 1 will be illustrated.

The image forming apparatus 1 includes a control device 10, a sheet feeding device 20, a photoconductor unit 30, a developing device 40, an exposure device 50, a transfer device 60, and a fixing device 70.

An upper cover 80 that also serves as an exit tray to which the image recorded paper is discharged or in which the image recorded paper is received is provided to the upper surface (the Z direction) of the image forming apparatus 1.

A front cover 90 that allows the inner portion of the image forming apparatus 1 to be opened in the front direction (in the X direction) in a case of exchange of the consumables or the like is rotatably supported to the front surface of the image forming apparatus 1.

A rear cover 100 that allows the inner portion of the image forming apparatus 1 to be opened in the rear direction (in the −X direction) in a case of a paper jam, internal inspection, or the like is rotatably supported to the rear surface of the image forming apparatus 1.

The control device 10 includes a controller 11 of the image forming apparatus that controls an operation of the image forming apparatus 1, a controller unit 12 that prepares image data according to a print processing request, an exposure controller 13 that controls the lighting of the light source of the exposure device 50, a power supply device 14, or the like. The power supply device 14 applies voltage to a charging roller 32, a developing roller 42, a transfer roller 62, or the like, which are described below and supplies power to the exposure device 50.

The controller unit 12 converts image data which is input from an image reading apparatus (not illustrated) or print information which is input from an external information transmission apparatus (for example, a personal computer or the like) into image information for forming a latent image and then outputs a drive signal to the exposure controller 13 at the preset timing.

The sheet feeding device 20 is provided in the bottom portion of the image forming apparatus 1. The sheet feeding device 20 includes a paper cassette 21. Paper P as plural recording mediums is stacked on the upper surface of the paper cassette 21. The paper P of which the position in the width direction is determined by a regulation plate (not illustrated) is withdrawn one by one from the upper side in the rear direction (in the −X direction) by a paper withdrawal unit 22 and is transported to a contact portion of a pair of resist rollers 23.

The photoconductor unit 30 is provided at the upper side of the sheet feeding device 20, and includes a photoconductor drum 31 which rotates to drive in the inside of a unit housing 35. The charging roller 32, the developing device 40, the transfer roller 62, and a cleaning blade 34 are disposed along the rotating direction of the photoconductor drum 31. A cleaning roller 33 which cleans the surface of the charging roller 32 is disposed to face and be in contact with the charging roller 32.

The developing device 40 includes a developing housing 41 of which a developer is contained in the inner portion. A developing roller 42 which is disposed to face the photoconductor drum 31 and a pair of augers 44 and 45 which agitates and transports the developer to the developing roller 42 and is on the inclined lower side of the rear surface side of the developing roller 42 are provided in the developing housing 41. A layer regulation roller 46 which regulates a layer thickness of the developer is disposed to be close to the developing roller 42.

The exposure device 50 includes a light emitting diode (LED) head in which plural LEDs are disposed in a linear shape along a main scanning direction and exposes the surface of the photoconductor drum 31 with a modulated light according to data of an image to be formed.

The exposure device 50 moves with respect to the main body of the apparatus between a light exposing position at which the photoconductor drum 31 is exposed with light and a retracted position which is separated from the photoconductor drum 31, in a state of being held in a holding member 51 by the opening and closing operation of the front cover 90.

The surface of the rotating photoconductor drum 31 is charged by the charging roller 32 and an electrostatic latent image is formed by the exposure device 50. The electrostatic latent image formed on the photoconductor drum 31 is developed as a toner image by the developing roller 42.

The transfer device 60 includes the rear cover 100 which seperatably supports the transfer roller 62 to the photoconductor drum 31 and the transfer roller 62 which forms a nip with the photoconductor drum 31. A transfer voltage from the power supply device 14 which is controlled by the controller 11 of the image forming apparatus is applied to the transfer roller 62 and the toner image on the photoconductor drum 31 is transferred on the paper P which passes through between the photoconductor drum 31 and the transfer roller 62.

A residual toner on the surface of the photoconductor drum 31 is removed by the cleaning blade 34 and is collected in the inside of the unit housing 35 which supports the photoconductor drum 31. Subsequently, the surface of the photoconductor drum 31 is charged again by the charging roller 32. Furthermore, the residue which is not removed by the cleaning blade 34 and thus is attached to the charging roller 32 is captured on the surface of the cleaning roller 33 which rotates while being in contact with the charging roller 32 and thus is temporarily stored in the charging roller 32.

The fixing device 70 includes a pair of heating module 71 and a pressuring module 72. A fixing nip portion (fixing region) is formed by a pressure contact region of the heating module 71 and the pressuring module 72.

The paper P on which the toner image is transferred by the transfer roller 62 is transported to the fixing device 70 via a transport guide 64 in a state where the toner image is unfixed. The toner image is fixed to the paper P which is transported to the fixing device 70 by press contact and heating by the pair of the heating module 71 and the pressuring module 72. The paper P on which the fixed toner image is formed is discharged from a pair of discharging rollers 74 to the upper cover 1*c* of the upper surface of the image forming apparatus 1.

(2) Opening and Closing Structure

Figure 2:
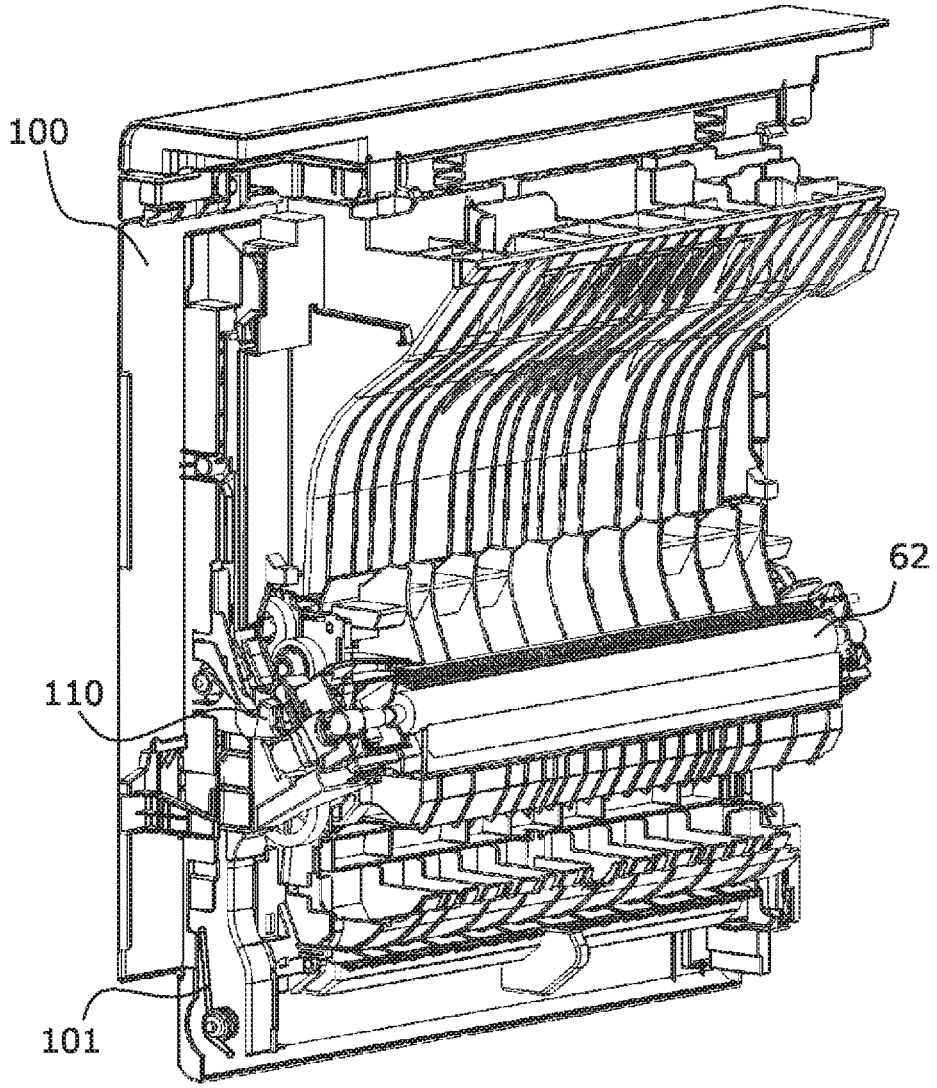
FIG. 2 is a perspective view illustrating the inner surface side of a rear cover of the image forming apparatus.
Figure 3:
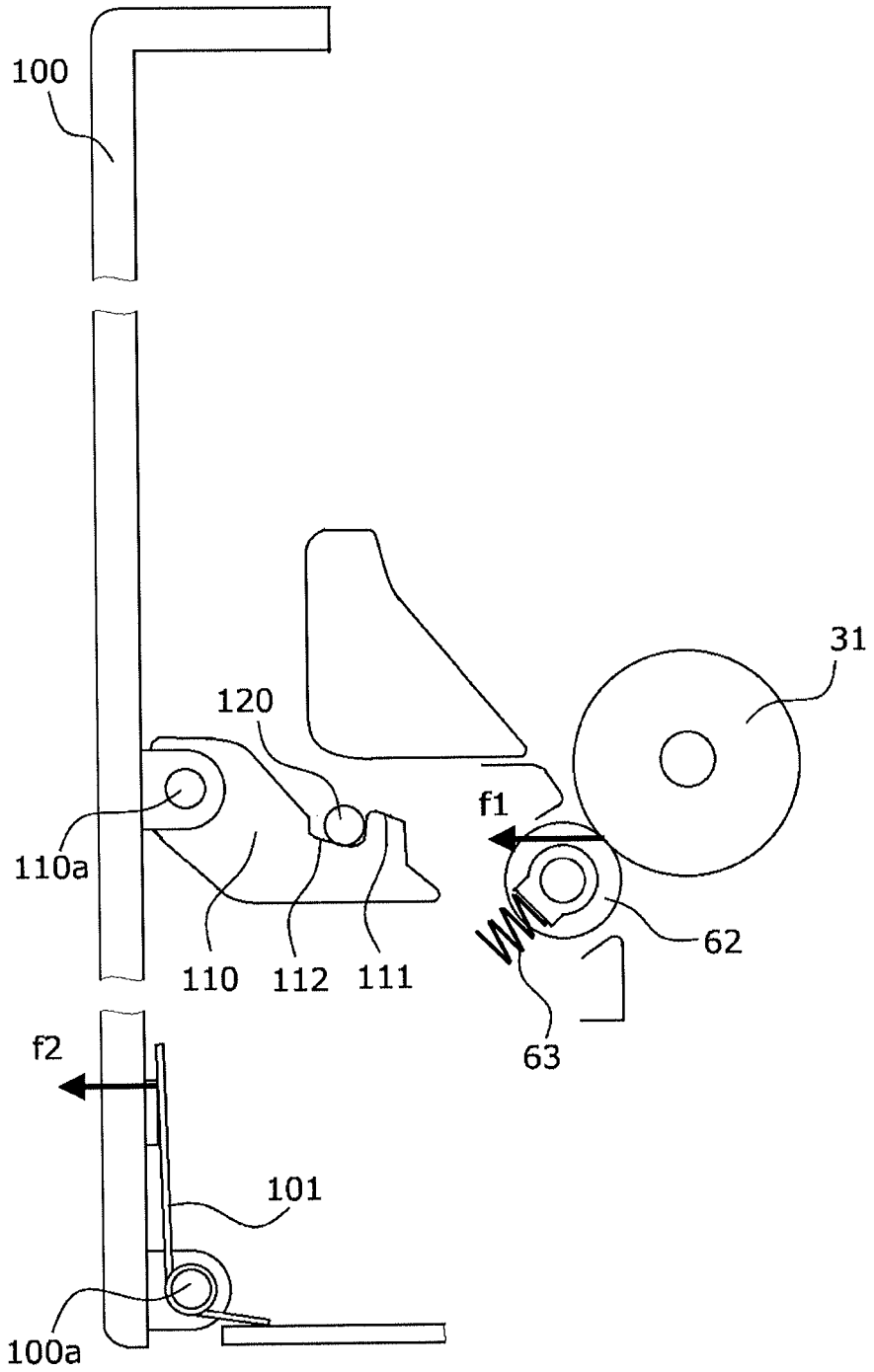
FIG. 3 is a cross-sectional schematic diagram of a main portion illustrating a state where the rear cover of the image forming apparatus is engaged to a main body of the apparatus at a closing position.

FIG. 2 is a perspective view illustrating the inner surface side of the rear cover 100 of the image forming apparatus 1 and FIG. 3 is a cross-sectional schematic diagram of a main portion illustrating a state where the rear cover 100 of the image forming apparatus 1 is engaged with the main body of the apparatus at the closing position.

Hereinafter, with reference to the drawings, the opening and closing structure of the image forming apparatus 1 related to the exemplary embodiment will be described.

In FIG. 1, the rear cover 100 as an example of the opening and closing member which is rotatably supported to the left side of the image forming apparatus 1 is movably supported between an opening position at which the inner portion of the main body of the apparatus is opened and a closing position at which the inner portion of the main body of the apparatus is closed.

A rotating shaft 100*a* is formed on the lower end portion of the rear cover 100, and the rear cover 100 is rotatably supported to the main body of the apparatus by the rotating shaft 100*a*.

A torsion spring 101 as an example of a reaction force generating mechanism is held to be wound in the rotating shaft 100*a* so that one end of the torsion spring is fixed to the main body of the apparatus and the other end thereof is in contact with the inner surface of the rear cover 100. As a result, a reaction force which urges toward the opening position acts on the rear cover 100 when the rear cover 100 moves from the opening position to the closing position.

In addition, when the transfer roller 62 is in contact with the surface of the photoconductor drum 31 according to the closing operation of the rear cover 100, the reaction force of a compression spring 63 which compresses the transfer roller 62 toward the photoconductor drum 31 is generated and the related reaction force acts as an internal reaction force urging toward the opening position with respect to the rear cover 100.

An engaging member 110 includes a guiding surface 111 which guides the engaging member 110 to the engaging position while being in contact with the engaging shaft 120 provided in the main body of the apparatus and a concave engaging portion 112 into which the engaging shaft 120 is fitted. The engaging member 110 is rotatably supported to the both sides in the lateral direction (in the Y direction, −Y direction) of the rear cover 100 while being urged in the rotating direction by the torsion spring (not illustrated) at the rotation center 110*a*.

The pair of resist rollers 23 which transports the paper P sent from the sheet feeding device 20 while aligning the paper P, the photoconductor unit 30, and the fixing device 70 are disposed on the main body side of the apparatus of which the rear cover 100 is opened.

The transfer roller 62 and the transport guide 64 which guides the paper P on which the toner image is transferred from the transfer roller 62 to the fixing device 70 are provided on the inner surface side of the rear cover 100.

The engaging member 110 is rotatably supported to the both sides of the rear cover 100 in the lateral direction, and the engaging member 110 is fitted into the engaging shaft 120 (illustrated in FIG. 3) as an engaged member provided in the main body of the apparatus and thus the left side of the main body of the apparatus becomes a closed state.

In a case where a paper jam is generated in the image forming apparatus 1, engagement between the engaging member 110 and the engaging shaft 120 with each other is released and then the rear cover 100 rotates to be moved to the opening position at which the inner portion of the main body of the apparatus is opened (−X direction). According to this, the nip of the transfer roller 62 and the photoconductor drum 31, and the transport guide 64 are opened and then the paper removal is performed.

(3) Opening and Closing Operation of the Opening and Closing Member

Figure 6:
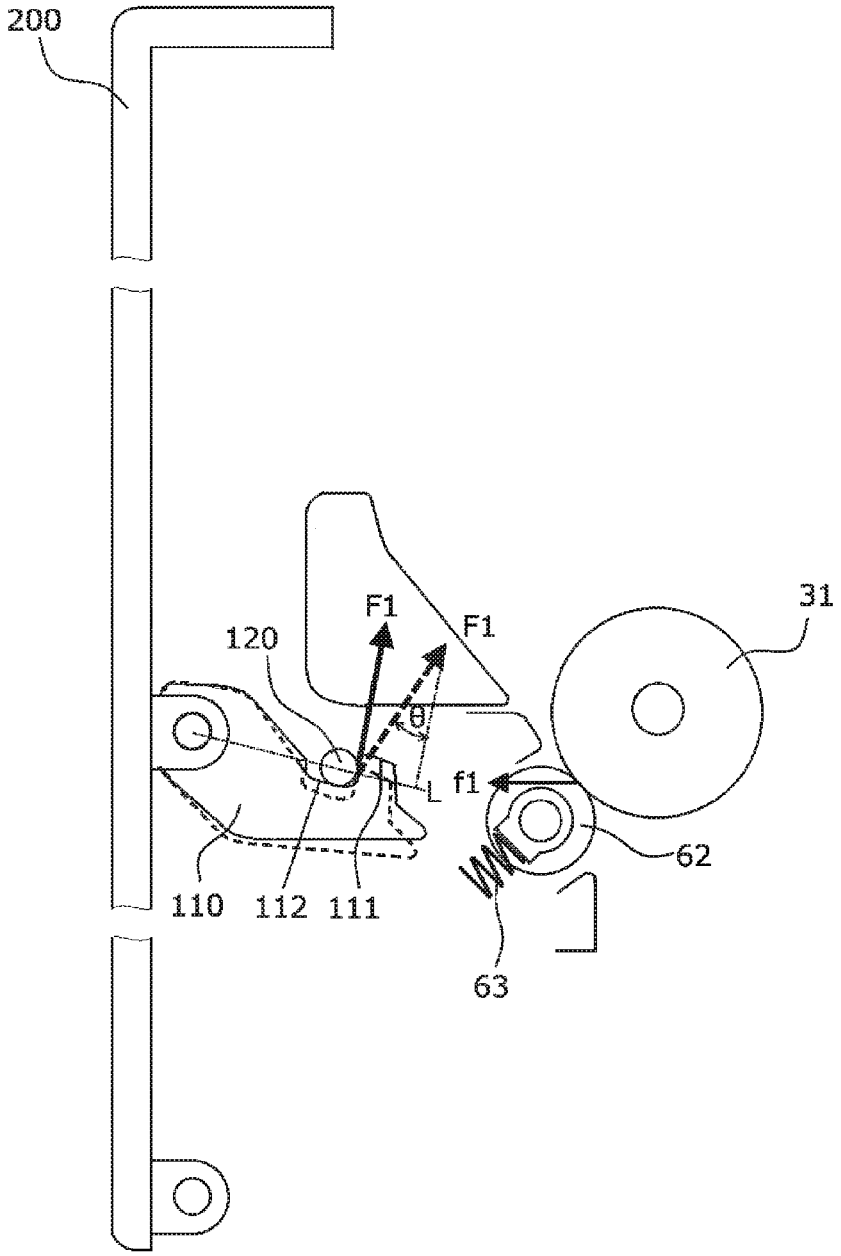
FIG. 6 is a cross-sectional schematic diagram illustrating a force acting on an engaging member when a rear cover of a comparative example moves from an opening position to a closing position.
Figure 7:
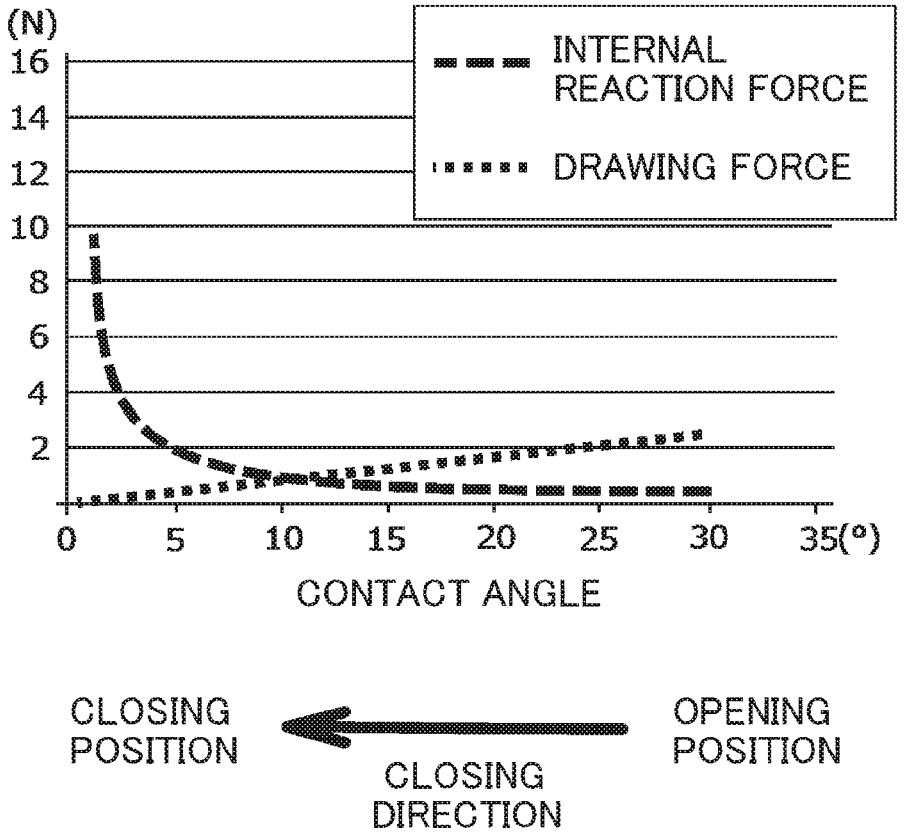
FIG. 7 is a view illustrating a relationship between a drawing force and an internal reaction force acting when the rear cover of the comparative example moves from the opening position to the closing position.
Figure 8:
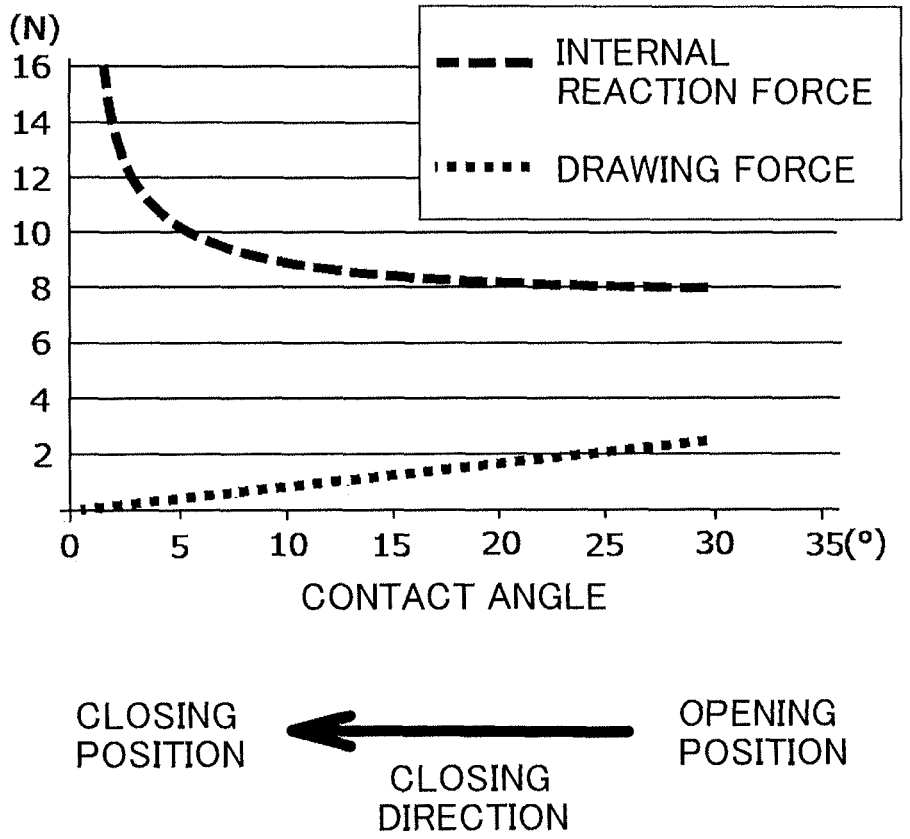
FIG. 8 is a view illustrating a relationship between a drawing force and an internal reaction force acting when the rear cover moves from the opening position to the closing position.

FIG. 6 is a cross-sectional schematic diagram illustrating a force acting on the engaging member 110 when a rear cover 200 of a comparative example moves from the opening position to the closing position; FIG. 7 is a view illustrating a relationship between a drawing force and an internal reaction force acting when the rear cover 200 of the comparative example moves from the opening position to the closing position; and FIG. 8 is a view illustrating a relationship between a drawing force and an internal reaction force acting when the rear cover 100 moves from the opening position to the closing position.

Hereinafter, with reference to the drawings, the opening and closing operation of the rear cover 100 related to the exemplary embodiment will be described.

(3.1) Engaging Member of Comparative Example

As illustrated in FIG. 6, the rear cover 200 of the comparative example includes a guiding surface 111 which guides the engaging member 110 to the engaging position while being in contact with the engaging shaft 120 provided in the main body of the apparatus, and a concave engaging portion 112 into which the engaging shaft 120 is fitted. In addition, the rear cover 200 includes the engaging member 110 which is rotatably supported while being urged in the rotating direction by the torsion spring (not illustrated) at the rotation center 110*a*.

In a case where the closing operation with respect to the rear cover 200 having the engaging member 110 is performed, at the time of the closing operation, when the guiding surface 111 of the engaging member 110 and the engaging shaft 120 which is provided in the main body of the apparatus are in contact with each other, a constant internal reaction force is generated in the engaging member 110 (see f1 in FIG. 6). However, the operation reaction force is not greatly increased according to the closing operation of the rear cover 200 (see dashed lines in FIG. 7) since the guiding surface 111 has a uniform shape as a shape for guiding the engaging shaft 120.

When the closing operation of the rear cover 200 is further continued, the engaging shaft 120 is disengaged from the end portion of the guiding surface 111 and then is fitted into the concave engaging portion 112 (see dashed lines in FIG. 6).

Then, when the concave engaging portion 112 is fitted into the engaging shaft 120, an engaging force is generated in the engaging member 110 (see F1 in FIG. 6) and a drawing force F2(F1·sin θ) toward the main body side of the apparatus is generated in the rear cover 200 according to a contact angle (see θ in FIG. 6) between the concave engaging portion 112 and the engaging shaft 120 when the concave engaging portion 112 is fitted into the engaging shaft 120 (see dotted lines in FIG. 7).

As illustrated in FIG. 7, after the concave engaging portion 112 is fitted into the engaging shaft 120, while the drawing force becomes small, the pressing force by the nip of the transfer roller 62 and the photoconductor drum 31 is added. Accordingly, an internal reaction force (f1) exceeding the drawing force is generated and the engaging member 110 is engaged to the engaging shaft 120 and thus the internal reaction force is rapidly increased (see dashed lines in FIG. 7).

As illustrated in FIG. 7, in the closing operation of the related rear cover 200, a position at which the drawing force F2 based on the engaging force F1 and the internal reaction force (f1) are balanced is generated, and in a case where the closing operation of the rear cover 200 is stopped at the balanced position related and thus the rotation of the engaging member 110 is stopped, the rear cover 200 is substantially positioned at the closing position (an irregular position), since the concave engaging portion 112 of the engaging member 110 is started to be fitted into the engaging shaft 120 of the main body of the apparatus.

Meanwhile, in a case where the main body of the apparatus is operated at the balanced position related, an irregular operation occurs and thus there is concern that failure is generated on the main body of the apparatus.

(3.2) Effect of Reaction Force Generating Mechanism

As illustrated in FIG. 3, in the rear cover 100 according to the exemplary embodiment, the torsion spring 101 as an example of the reaction force generating mechanism is held to be wound around the rotating shaft 100*a* so that one end of the torsion spring 101 is fixed to the main body of the apparatus and the other end thereof is in contact with the inner surface of the rear cover 100.

Therefore, a reaction force (f2) which urges toward the opening position acts on the rear cover 100 when the rear cover 100 moves from the opening position to the closing position.

Then, in a case where the closing operation is performed with respect to the rear cover 100 having the engaging member 110, at the time of the closing operation, when the guiding surface 111 of the engaging member 110 and the engaging shaft 120 which is provided in the main body of the apparatus are in contact with each other, a constant internal reaction force (see f1 in FIG. 6) is generated in the engaging member 110. However, a reaction force (f1+f2) to which a reaction force (f2) due to the torsion spring 101 is added acts on the rear cover 100.

Therefore, as illustrated in FIG. 8, in the closing operation of the related rear cover 100, the internal reaction force (f1+f2) is normally greater than the drawing force F2 based on the engaging force F1 and is not balanced with the drawing force, in a case where the closing operation of the rear cover 100 is stopped and thus the rotation of the engaging member 110 is stopped, an urging force toward the opening position normally acts on the rear cover 100, and thus the rear cover 100 is not stopped at an irregular position.

Therefore, in a case where an operator does not completely perform a closing operation, the main body of the apparatus is not operated and thus generation of a failure by irregular operations can be restricted.

Second Exemplary Embodiment

Figure 4:
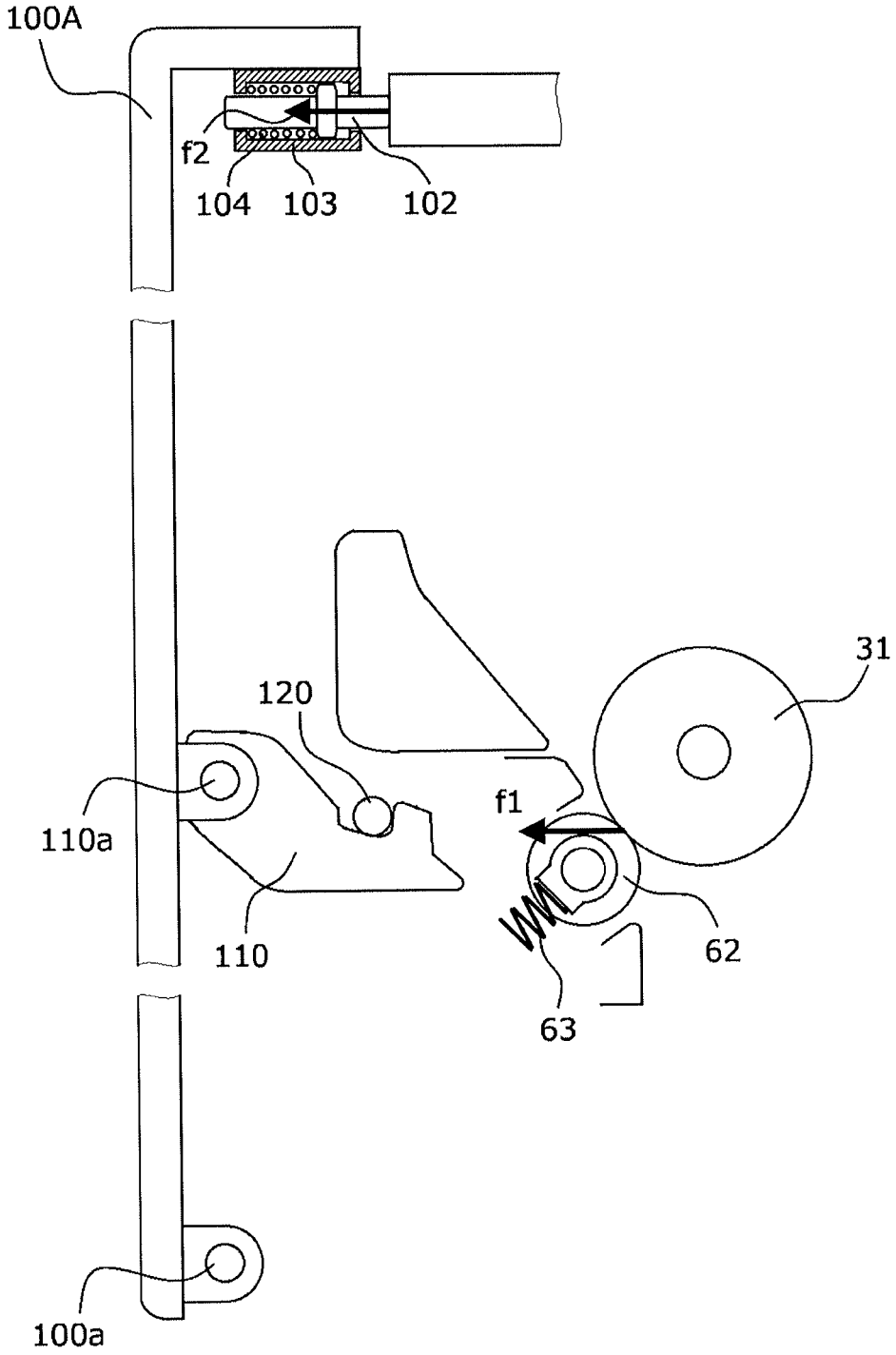
FIG. 4 is a cross-sectional schematic diagram of a main portion illustrating a state where a rear cover is engaged to a main body of the apparatus at a closing position.

FIG. 4 is a cross-sectional schematic diagram of a main portion illustrating a state where the rear cover 100A according to the exemplary embodiment is engaged to the main body of the apparatus at the closing position.

Hereinafter, with reference to the drawings, the opening and closing operation of the rear cover 100A related to the exemplary embodiment will be described. However, the same reference numeral is denoted in the common configuration with the first exemplary embodiment and the detailed description thereof is omitted.

As illustrated in FIG. 4, the rear cover 100A includes a plunger 102, as an example of the reaction force generating mechanism, which is movably supported to the moving direction of the rear cover 100A in the rear cover 100A and is pressed by the movement of the rear cover 100A from the opening position to the closing position.

The plunger 102 is provided at the center portion of the rear cover 100A so that a front end side thereof protrudes in the moving direction of the rear cover 100A toward the closing direction via a coil spring 104 in the case body 103. Then, in a case where the closing operation is performed with respect to the rear cover 100A, the front end portion of the plunger 102 is in contact with the main body of the apparatus, and the reaction force (f1+f2) to which the reaction force (f2) due to the coil spring 104 urging the plunger 102 is added acts on the rear cover 100A.

Therefore, as illustrated in FIG. 8, in the closing operation of the related rear cover 100A, the internal reaction force (f1+f2) is normally greater than the drawing force F2 based on the engaging force F1, in a case where the closing operation of the rear cover 100A is stopped and thus the rotation of the engaging member 110 is stopped, an urging force toward the opening position normally acts on the rear cover 100A, and thus the rear cover 100A is not stopped at an irregular position.

Therefore, in a case where an operator does not completely perform a closing operation, the main body of the apparatus is not operated and thus generation of a failure by irregular operations can be restricted.

Third Exemplary Embodiment

Figure 5:
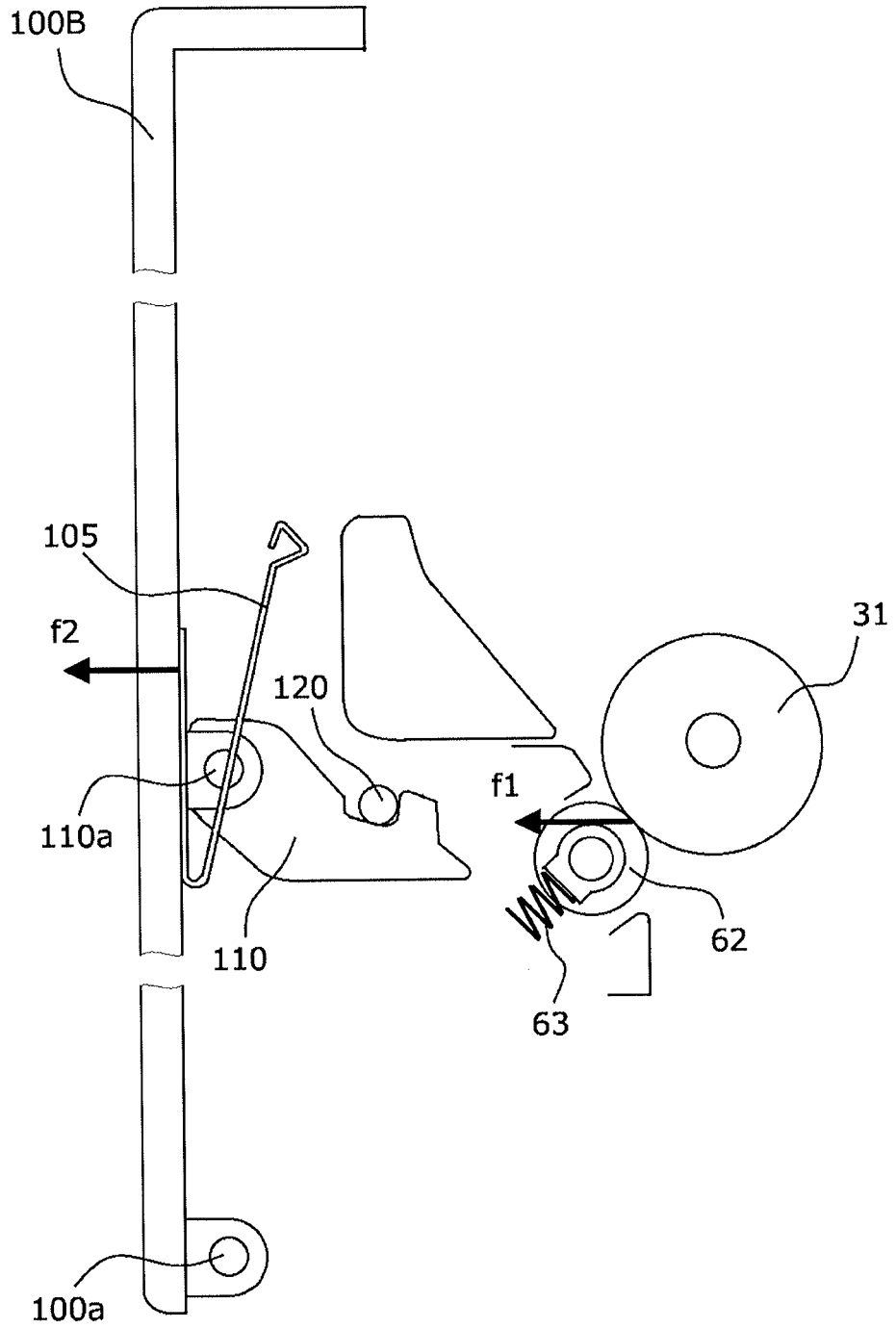
FIG. 5 is a cross-sectional schematic diagram of a main portion illustrating a state where a rear cover is engaged to a main body of the apparatus at a closing position.

FIG. 5 is a cross-sectional schematic diagram of a main portion illustrating a state where a rear cover 100B according to the exemplary embodiment is engaged to the main body of the apparatus at the closing position.

Hereinafter, with reference to the drawings, the opening and closing operation of the rear cover 100B related to the exemplary embodiment will be described. However, the same reference numeral is denoted in the common configuration with the first exemplary embodiment and the detailed description thereof is omitted.

As illustrated in FIG. 5, the rear cover 100B includes a leaf spring 105, as an example of the reaction force generating mechanism, which is disposed on an inner surface of the rear cover 100B and is pressed to be deformed by the movement of the rear cover 100B from the opening position to the closing position.

Then, in a case where the closing operation is performed with respect to the rear cover 100B, the front end portion of the leaf spring 105 is in contact with the main body of the apparatus, and the reaction force (f1+f2) to which the reaction force (f2) due to the leaf spring 105 is added acts on the rear cover 100B.

Therefore, as illustrated in FIG. 8, in the closing operation of the related rear cover 100B, the internal reaction force (f1+f2) is normally greater than the drawing force F2 based on the engaging force F1, in a case where the closing operation of the rear cover 100B is stopped and thus the rotation of the engaging member 110 is stopped, an urging force toward the opening position normally acts on the rear cover 100B, and thus the rear cover 100B is not stopped at an irregular position.

Therefore, in a case where an operator does not completely perform a closing operation, the main body of the apparatus is not operated and generation of a failure by irregular operations can be restricted.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an opening and closing member that is movably supported between an open position at which an inner portion of a main body of the apparatus is opened and a closed position at which the inner portion of the main body of the apparatus is closed;

an engaged portion that is provided in the main body of the apparatus;

an engaging member that is provided with the opening and closing member and is engaged to the engaged portion;

a reaction force generating mechanism that is provided with the opening and closing member, and urges the opening and closing member toward the open position when the opening and closing member moves from the open position to the closed position; and an image forming part that is provided in the main body of the apparatus, wherein wherever the opening and closing member is positioned between the open position and the closed position, an internal reaction force, which acts to urge the opening and closing member toward the open position and includes a reaction force generated by the image forming part and a reaction force generated by the reaction force generating mechanism, is larger than a drawing force, which acts to urge the opening and closing member toward the closed position and is based on an engaging force generated when the engaging member is fitted into the engaged portion.

2. The image forming apparatus according to claim 1, wherein the reaction force generating mechanism increases the internal reaction force that urges the opening and closing member toward the open position according to movement of the opening and closing member from the open position to the closed position until the engaging member and the engaged member are engaged with each other.

3. The image forming apparatus according to claim 2, wherein the reaction force generating mechanism is a torsion spring that is wound around a support shaft of the opening and closing member so that one end of the torsion spring is fixed to the main body of the apparatus and the other end thereof is in contact with an inner surface of the opening and closing member.

4. The image forming apparatus according to claim 2, wherein the reaction force generating mechanism is a plunger that is supported by the opening and closing member to be movable in a moving direction of the opening and closing member and is pressed by the movement of the opening and closing member from the open position to the closed position.

5. The image forming apparatus according to claim 2, wherein the reaction force generating mechanism is a leaf spring that is disposed on an inner surface of the opening and closing member and is pressed and deformed by the movement of the opening and closing member from the open position to the closed position.

6. An image forming apparatus comprising:

a main body that includes an engaged portion and an opening;

an opening and closing member that includes an engaging member and a reaction force generating portion, and is supported to be movable between an open position at which an inner portion of the main body is exposed to an outside of the main body through the opening and a closed position at which the opening and closing member closes the opening; and an image forming part that is provided in the main body of the apparatus, wherein:

the reaction force generating portion urges the opening and closing member toward the open position when the opening and closing member is moved from the open position to the closed position, and wherever the opening and closing member is positioned between the open position and the closed position, an internal reaction force, which acts to urge the opening and closing member toward the open position and includes a reaction force generated by the image forming part and a reaction force generated by the reaction force generating portion, is larger than a drawing force, which acts to urge the opening and closing member toward the closed position and is based on an engaging force generated when the engaging member is fitted into the engaged portion.

7. An image forming apparatus comprising:

an opening and closing member that is movably supported between an open position at which an inner portion of a main body of the apparatus is opened and a closed position at which the inner portion of the main body of the apparatus is closed;

an engaged portion that is provided in the main body of the apparatus;

an engaging member that is provided with the opening and closing member and is engaged to the engaged portion;

a reaction force generating mechanism that is provided with the opening and closing member, and urges the opening and closing member toward the open position when the opening and closing member moves from the open position to the closed position, wherein:

one end of the opening and closing member is rotatably supported around a rotation center, and the reaction force generating mechanism urges the opening and closing member at a position that is farther from the rotation center than a position of the engaging member from the rotation center.

* * * * *